US005095181A

United States Patent [19]

Osika et al.

[11] Patent Number: 5,095,181

[45] Date of Patent: Mar. 10, 1992

[54] THREE-POSITION SAFETY ROCKER

[75] Inventors: Thomas F. Osika, Valparaiso; John A. Stuhlmacher, Crown Point, both of Ind.

[73] Assignee: McGill Manufacturing Company, Inc., Valparaiso, Ind.

[21] Appl. No.: 628,981

[22] Filed: Dec. 17, 1990

Related U.S. Application Data

[63] Continuation of Ser. No. 308,734, Feb. 9, 1989, abandoned, which is a continuation-in-part of Ser. No. 114,129, Oct. 28, 1987, Pat. No. 4,870,230.

[51] Int. Cl.[5] ..... H01H 9/28; H01H 3/00

[52] U.S. Cl. ..... 200/43.16; 200/339

[58] Field of Search ..... 200/43.01, 43.16, 321, 200/322, 339

[56] References Cited

U.S. PATENT DOCUMENTS

| | | | |
|---|---|---|---|
| 4,215,257 | 7/1980 | Repplinger | 200/322 |
| 4,947,009 | 8/1990 | Osika et al. | 200/43.16 |
| 5,041,706 | 8/1991 | Osika et al. | 200/338 |
| 5,045,648 | 9/1991 | Fogleman, Sr. | 200/339 |
| 5,047,598 | 9/1991 | Osika et al. | 200/43.16 |

FOREIGN PATENT DOCUMENTS

| | | | |
|---|---|---|---|
| 1947014 | 3/1971 | Fed. Rep. of Germany | 200/321 |

*Primary Examiner*—Ernest G. Cusick
*Assistant Examiner*—David J. Walczak
*Attorney, Agent, or Firm*—Leydig, Voit & Mayer

[57] ABSTRACT

A three-position electrical switch includes a rocker-type actuator adapted to be pivoted within a housing in opposite directions from a neutral position to first and second actuated positions in order to close first and second sets of switch contacts. The actuator carries a latch which normally engages the housing to prevent the actuator from being pivoted from its neutral position to either of its switch-closed positions. By manually pulling on the latch and then pivoting the actuator, the actuator may be moved to either of its switch-closed positions; the two-step operation protecting against accidental actuation of the switch. The actuator is frictionally maintained in one of its switch-closed positions but may be returned to its switch-open position by a simple single motion thereby enabling rapid opening of the switch under emergency conditions. The actuator is only momentarily held in its other switch-closed position and returns automatically therefrom as soon as it is manually released.

10 Claims, 2 Drawing Sheets

THREE-POSITION SAFETY ROCKER

CROSS-REFERENCE TO A RELATED APPLICATION

This is a continuation of copending application Ser. No. 07/308,734, filed on Feb. 9, 1989, which is a continuation-in-part of application Ser. No. 07/114,129, filed Oct. 28, 1987, now U.S. Pat. No. 4,870,230, filed Oct. 28, 1987.

BACKGROUND OF THE INVENTION

This invention relates generally to an electrical switch of the type having a pivotally mounted rocker actuator.

More specifically, the invention relates to a three-position switch having an actuator which is supported to pivot in one direction from a centered or neutral position to a first actuated position and in the opposite direction from the neutral position to a second actuated position. Such a switch includes two sets of contacts which are in a first state (e.g., open) as long as the actuator is in its neutral position. The actuator changes the state of one set of contacts when it is pivoted to its first actuated position and changes the state of the other set of contacts when it is pivoted to its second actuated position.

With certain types of equipment such as power tools, power take-off attachments for tractors, and other equipment which might possibly cause injury, it is desirable to protect the switch against accidental actuation. While certain safety switches have been designed to guard against accidental actuation, such switches are relatively complex and expensive and, in some instances, can still be actuated accidentally in spite of the measures which are taken to ostensibly prevent such actuation.

SUMMARY OF THE INVENTION

The general aim of the present invention is to provide a new and improved three-position rocker switch which is of comparatively simple and low cost construction and which effectively guards against accidental actuation.

A more detailed object of the invention is to achieve the foregoing by providing a three-position rocker switch which can be actuated only if two separate and distinct motions are applied to the switch actuator.

A further object is to provide a three-position rocker switch of the foregoing type which is placed and maintained in an actuated state when the actuator is pivoted to one actuated position and manually released and which is only momentarily placed in an actuated state when the actuator is pivoted to its other actuated position and manually released.

Another object is to provide a three-position rocker switch in which the actuator, when being maintained in an actuated position, can be manually returned to the neutral position with a simple single motion so as to simplify opening of the switch and permit rapid opening under emergency conditions.

These and other objects and advantages of the invention will become more apparent from the following detailed description when taken in conjunction with the accompanying drawings.

DETAILED DESCRIPTION OF THE PREFERRED EMBODIMENTS

Figure 1:
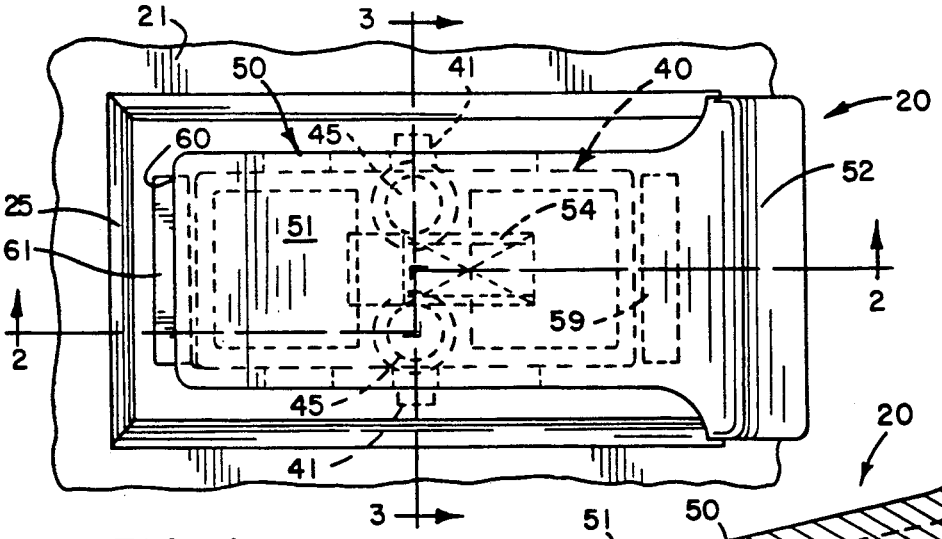
FIG. 1 is a top plan view of a new and improved three-position safety switch incorporating the unique features of the present invention.

For purposes of illustration, the present invention has been shown in the drawings as being incorporated in an electrical switch 20 for making or breaking circuits to one or more electrical utilization devices (not shown). By way of example, one utilization device may be a solenoid which, when energized, causes the power take-off of a tractor to engage. The switch may be used solely with the solenoid or may be used both with the solenoid and with another electrical utilization device.

In the present instance, the switch 20 has been shown in conjunction with a mounting plate 21 which is formed with a rectangular hole 22 for receiving the switch. The switch includes a main body or housing 23 (FIG. 2) which is partially defined by a molded plastic sleeve 24 of rectangular cross-section telescoped into the opening 22 and formed with a peripheral flange 25 which engages the upper side of the plate around the margins of the opening. Cantilevered fingers 26 are molded integrally with and are hinged to the sleeve and are adapted to pass through the opening 22 during insertion of the sleeve into the opening. Just after such insertion, the fingers 26 spring outwardly and engage the lower portion of the edge of the opening 22 so as to hold the sleeve 24 in the opening.

The housing 23 also includes an upwardly opening cup 27 (FIG. 2) made of plastic and adapted to be telescoped into the lower end portion of the sleeve 24, the upper edge of the cup engaging a radially inwardly projecting flange 28 formed integrally with the sleeve about midway along the height of the sleeve. An annular rib 29 on the lower end portion of the sleeve 24 snaps into an annular groove 30 in the lower end portion of the cup 27 in order to hold the sleeve and the cup in assembled relation.

Located in the bottom of the cup 24 are two side-by-side sets of spaced switch contacts 31 and 32 (FIG. 2) connected to terminals 33 and 34, respectively. Only one set of contacts 31 and 32 and one set of terminals 33 and 34 are visible in the drawings but it should be understood that the other set of contacts and the other set of terminals are disposed alongside those which have been illustrated.

Figure 2:
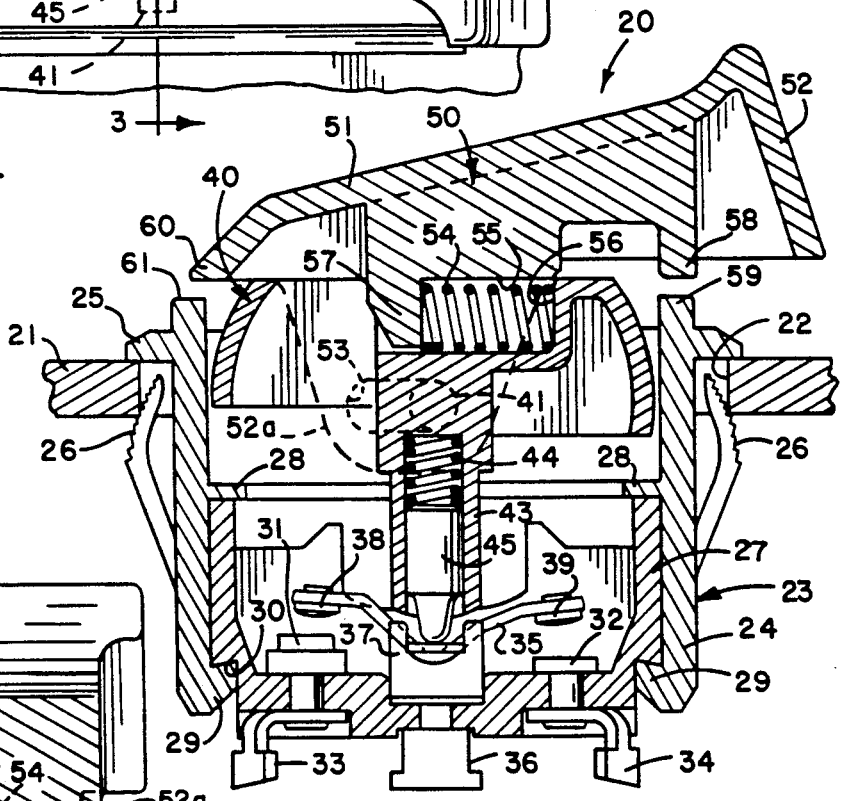
FIGS. 2 and 3 are fragmentary cross-sections taken substantially along the lines 2–2 and 3–3, respectively, of FIG. 1.
Figure 4:
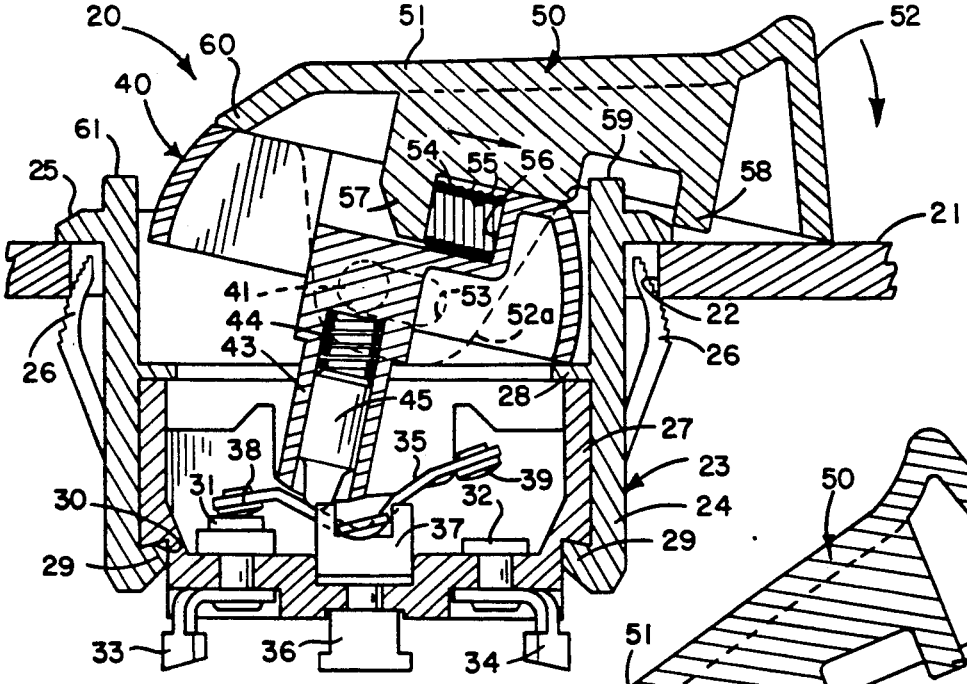
FIGS. 4 and 5 are views generally similar to FIG. but show different moved positions of certain components of the switch.

Positioned between the contacts 31 and 32 of each set is a generally V-shaped arm 35 connected to a terminal 36 and supported to rock about a fulcrum 37. Carried on the opposite end portions of each arm are contacts 38 and 39 which are adapted to engage the contacts 31 and 32, respectively. When the arm 35 is located as shown in FIG. 2, it is disposed in a centered or neutral position in which the contacts 38 and 39 are spaced above the contacts 31 and 32 so as to keep the switch 20 in an open state. Counterclockwise pivoting of the arm 35 about the fulcrum 37 brings the contact 38 downwardly into engagement with the contact 31 as shown in FIG. 4 to complete a circuit between the terminals 33 and 36 and energize a utilization device in the circuit. Conversely, the contact 39 moves downwardly into engagement with the contact 32 and completes a circuit between the terminals 34 and 36 when the arm 35 is rocked clockwise about the fulcrum, 37 to the position shown in FIG. 5. When that circuit is completed, either the previously mentioned utilization device is energized or a different utilization device in the circuit is energized, depending upon which device is connected into the circuit.

Figure 3:
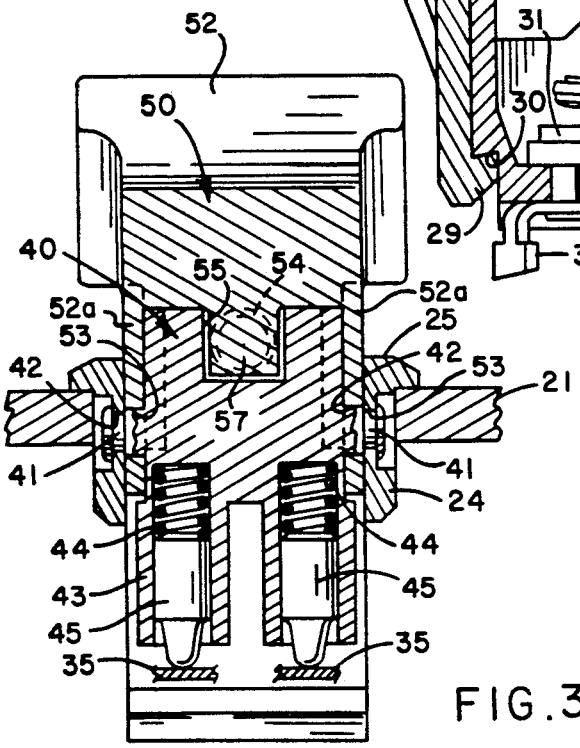
Figure 5:
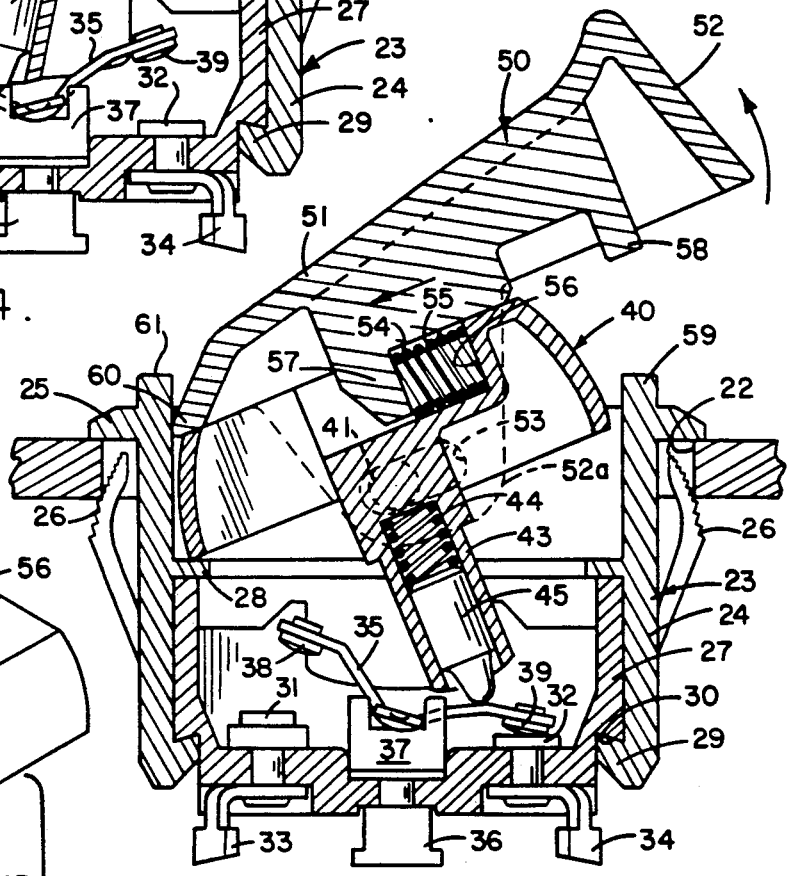
Figure 6:
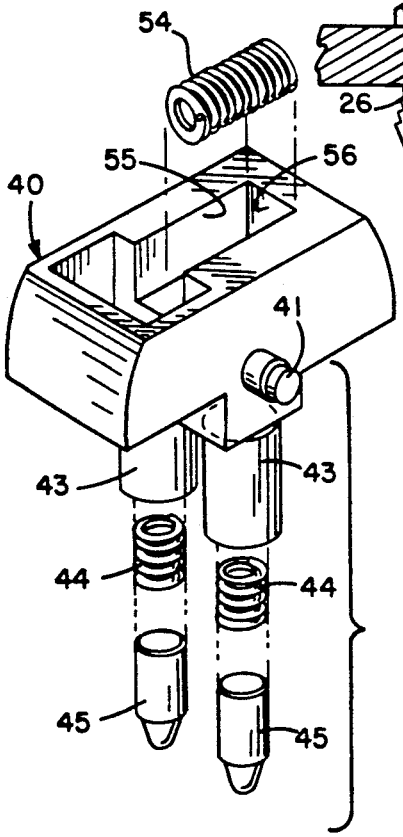
FIG. 6 is an exploded perspective view of certain components of the switch.

Pivoting of the contact arms 35 is effected by a rocker-type actuator 40 which is supported by the sleeve 24 of the housing 23 to pivot clockwise from a neutral position (FIG. 2) to a first actuated position (FIG. 4) and to pivot counterclockwise from the neutral position to a second actuated position (FIG. 5). Herein, the rocker 40 is molded of plastic and is formed with two oppositely extending pins 41 (FIGS. 3 and 6) which project through circular holes 42 (FIG. 3) in the sleeve 24 to support the rocker for pivoting about a horizontal axis. The rocker is formed with a pair of side-by-side and generally vertical sleeves 43 (FIGS. 3 and 6) which house springs 44 and plungers 45, the springs biasing the plungers downwardly against the contact arms 35. When the rocker 40 is located in its neutral position as shown in FIG. 2, the springs press the plungers downwardly against the central portions of the arms 35 and hold the arms in horizontal positions so as to keep the contacts 38 and 39 out of engagement with the contacts 31 and 32.

When the rocker 40 is pivoted clockwise about the axis of the pins 41 from the neutral position shown in FIG. 2 to the actuated position shown in FIG. 4, the plungers 45 ride from right-to-left along the arms 35 and bear downwardly against the left end portions of the arms. This causes the arms to pivot counterclockwise about the fulcrum 37 so as to press the contacts 38 downwardly against the contacts 31 and thereby close the switch 20. On the other hand, counterclockwise pivoting of the rocker 40 from the neutral position of FIG. 2 to the actuated position of FIG. 5 causes the plungers 45 to ride from left-to-right along the right end portions of the arms 35, to pivot the arms clockwise about the fulcrum 37 and to press the contacts 39 downwardly against the contacts 32.

In accordance with the present invention, the three-position switch 20 is provided with a relatively simple and inexpensive latch 50 which prevents the switch rocker 40 from being actuated to either of its switch-closed states unless two separate and distinct motions are applied to the switch. The latch, however, enables the switch to be de-actuated or opened from one of its closed states with a simple single motion and enables the switch to automatically open from its other closed state. Thus, the switch 20 is truly a safety switch in that separate motions are required for actuation so as to prevent accidental closing of the switch and yet, at the same time, the switch may be quickly opened under an emergency condition.

More specifically, the latch 50 includes an elongated plate 51 molded of plastic and formed with a somewhat enlarged gripping portion or handle 52 at one end Formed integrally with and depending from the plate are two laterally spaced ears 52*a* (FIGS. 2 and 3) which straddle the rocker 40. Each ear is formed with an elongated and generally horizontal slot 53 which receives the adjacent pin 41 with a sliding fit. The pins and slots thus mount the latch 50 for back and forth sliding on the rocker 40 between a latched position (FIG. 2) and an unlatched position (FIGS. 4 and 5). A coil spring 54 urges the latch toward its latched position. For this purpose, the spring is retained in the stem portion of a T-shaped slot 55 (FIG. 6) in the rocker 40 and is compressed between a wall 56 of the slot and a lug 57 which extends downwardly from the lower side of the plate 51 of the latch 50. The lug fits in the cross portion of the T-slot 55.

When the rocker 40 is in its neutral position as shown in FIG. 2, the latch 50 normally is in its latched position and, in this position a tongue 58 (FIG. 2) depending from the handle end portion of the latch plate 51 overlies a raised portion 59 on the upper end of the sleeve 24. If the rocker 40 is depressed and pivoted clockwise toward its first actuated position, the tongue 58 engages the raised portion 59 of the sleeve 24 and limits clockwise pivoting of the rocker to a very small angular distance which is insufficient to cause the contacts 38 to close downwardly against the contacts 31.

To close the contacts 38 against the contacts 31, the handle 52 of the latch 50 is gripped between a thumb and forefinger and the latch is slid from left-to right relative to the rocker 40 and against the biasing force of the spring 54 until the latch reaches its unlatched position shown in FIG. 4. As a result of such sliding, the tongue 58 of the latch clears the raised portion 59 of the sleeve 24 and permits the rocker to be pivoted clockwise to its first actuated position (FIG. 4) by pushing downwardly on the handle 52 of the latch. Accordingly, it is necessary to first pull on the latch and then depress the latch in order to pivot the rocker 40 clockwise to its first switch-closed position shown in FIG. 4.

As shown in FIG. 2, a nose 60 on the end of the latch plate 51 overlies a raised portion 61 on the upper end of the sleeve 24 when the rocker 40 is in its neutral position and the latch 50 is in its latched position. If the handle 52 of the latch is lifted while the latch is latched, the nose 60 engages the raised portion 61 of the sleeve and prevents the rocker from pivoting counterclockwise through a sufficient distance to close the contacts 39 against the contacts 32. Accordingly, the latch prevents the rocker from being accidentally pivoted to its second switch-closed position. By pulling on the handle 52 and sliding the latch 50 along the rocker 40, the nose 60 is retracted to a position clearing the raised portion 61 of the sleeve 24 and permitting the rocker to pivot counterclockwise through a distance sufficient to effect closing of the contacts 39 and 32. Thus, two distinct motions also are required to pivot the rocker to its second switch-closed position.

As shown in FIG. 2, the contacts 31 are located at a higher elevation than the contacts 32. As a result, the plungers 45 travel a relatively short distance along the contact arms 35 to close the contacts 38 and 31 (FIG. 4) and travel a somewhat longer distance along the arms to close the contacts 39 and 32 (FIG. 5). When the contacts 38 are fully closed against the contacts 31, the position of the plungers 45 along the arms 35 causes the springs 44 to urge the rocker 40 counterclockwise from its first switch-closed position (FIG. 4) toward its neutral position. At this time, the rocker 40 and the latch 50 are free both of positive engagement and of frictional engagement with the sleeve 24. Accordingly, the action of the springs 44 serves to return the rocker 40 from its first switch-closed position to its neutral position immediately when manual pressure is released from the handle 52 of the latch 50. Thus, movement of the rocker to is first switch-closed position is "momentary" in nature since the rocker automatically returns to its neutral position when a depressive force is no longer applied to the handle of the latch.

When the rocker 40 is in its second switch-closed position (FIG. 5), the location of the plungers 45 along the contact arms 35 renders the springs 44 ineffective to return the rocker clockwise to its neutral position when the lifting force is released from the handle 52 of the latch 50. In addition, when the handle 52 of the latch is released from between the thumb and forefinger, the spring 54 automatically presses the nose 60 of the latch into frictional engagement with the inner wall of the sleeve 24 to help hold the rocker 40 in a stable switch-closed position. Thus, the action of the rocker in its second switch-closed position is a "maintained" condition whereas the action of the rocker in its first switch-closed position is a "momentary" position. When the rocker is in its second switch-closed position, it may be returned quickly to its neutral position simply by depressing the handle 52 to overcome the frictional force between the nose 52 and the sleeve 24.

From the foregoing, it will be apparent that the present invention brings to the art a new and improved three-position safety switch 20 which requires two distinct motions for closing but only a single simple motion for opening. Moreover, the switch may be either momentarily closed or maintained in a closed state until positively moved from that state. A basic rocker switch essentially may be made as a safety switch 20 simply by incorporating the latch 50 and the spring 54 into the switch. Thus, the safety switch 20 may be produced at relatively low cost.

We claim:

1. A safety switch comprising a body mountable in an opening in a wall, said body having a pair of switch contacts each movable between first and second states, each of said contacts normally being disposed in said first state, a manually movable switch actuator having a neutral position in which said actuator leaves each of said contacts in said first state, said actuator being movable in one direction from said neutral position to a first actuated position in which the actuator changes of one of said contacts from said first state to said second state, said actuator being movable in the opposite direction from said neutral position to a second actuated position in which said actuator changes the other of said contacts from said first state to said second state, a latch mounted on said actuator and having a handle portion, said latch and said handle portion being movable with said actuator between said positions and being movable relative to said actuator between latched and unlatched positions, means biasing said latch toward said latched position, said latch being positively engageable with said body when said latch is in said latched position and said actuator is in said neutral position and acting to prevent movement of said actuator from said neutral position to either of said first and second actuated positions, and said latch being manually movable relative to said actuator to said unlatched position in a plane substantially parallel to said wall by manipulation of said handle portion while said actuator is in said neutral position for enabling movement of said actuator and latch from said neutral position to either of said first and second actuated positions.

2. A safety switch as defined in claim 1 further including, means for urging said actuator from said first actuated position toward said neutral position, said latch being free of positive and frictional engagement with said body when said actuator is in said first actuated position thereby to enable said urging means to return said actuator from said first actuated position to said neutral position when said actuator is manually released.

3. A safety switch comprising a housing mountable in an opening in a wall, said housing having a pair of switch contacts each movable between first and second states, each of said contacts normally being disposed in said first state, a switch actuator supported pivotally by said housing, said actuator having a neutral position in which said actuator leaves each of said contacts in said first state, said actuator being manually pivotable in one direction from said neutral position to a first actuated position in which the actuator changes one of said contacts from said first state to said second state, said actuator being manually pivotable in the opposite direction from said neutral position to a second actuated position in which said actuator changes the other of said contacts from said first state to said second state, a latch mounted on said actuator and having a handle portion, said latch and said handle portion being pivotable with said actuator between said positions and being slidable relative to said actuator between latched and unlatched positions, first biasing means for biasing said latch toward said latched position, said latch being positively engageable with said housing when said latch is in said latched position and said actuator is in said neutral position and acting to prevent pivoting of said actuator latch from said neutral position to either of said first and second actuated positions, and said latch being manually slidable relative to said actuator to said unlatched position in a plane substantially parallel to said wall by manipulation of said handle portion while said actuator is in said neutral position for enabling pivoting of said actuator from said neutral position to either said first and second actuated positions, second biasing means for urging said actuator to pivot from said first actuated position toward said neutral position, said latch being free of positive and frictional engagement with said housing when said actuator is in said first actuated position thereby to enable said second biasing means to return said actuator from said first actuated position to said neutral position when said actuator is manually released.

4. A safety switch comprising a body having a pair of switch contacts each movable between first and second states, each of said contacts normally being disposed in said first state, a manually movable switch actuator having a neutral position in which said actuator leaves each of said contacts in said first state, said actuator being movable in one direction from said neutral position to a first actuated position in which the actuator changes one of said contacts from said first state to said second state, said actuator being movable in the opposite direction from said neutral position to a second actuated position in which said actuator changes the other of said contacts from said first state to said second state, a latch mounted on said actuator and having a handle portion, said latch and said handle portion being movable with said actuator between said positions and being movable relative to said actuator between latched and unlatched positions, means biasing said latch toward said latched position, said latch being positively engageable with said body when said latch is in said latched position and said actuator is in said neutral position and acting to prevent movement of said actuator from said neutral position to either of said first and second actuated positions, said latch being manually movable to said unlatched position by manipulation of said handle portion and being operable when in said unlatched position to permit movement of said actuator from said neutral position to either of said first and second actuated positions, and said biasing means being operable for pressing said latch into frictional engagement with said body when said actuator is in said second actuated position for releasably maintaining said actuator in said second actuated position.

5. A safety switch comprising a housing having a pair of switch contacts each movable between first and second states, each of said contacts normally being disposed in said first state, a switch actuator supported pivotally by said housing, said actuator having a neutral position in which said actuator leaves each of said contacts in said first state, said actuator being manually pivotable in one direction from said neutral position to a first actuated position in which the actuator changes one of said contacts from said first state to said second state, said actuator being manually pivotable in the opposite direction from said neutral position to a second actuated position in which said actuator changes the other of said contacts from said first state to said second state, a latch mounted on said actuator and having a handle portion, said latch and said handle portion being pivotable with said actuator between said positions and being slidable relative to said actuator between latched and unlatched positions, first biasing means for urging said latch toward said latched position, said latch being positively engageable with said housing when said latch is in said latched position and said actuator is in said neutral position and acting to prevent pivoting of said actuator from said neutral position to either of said first and second actuated positions, said latch being manually slidable to said unlatched position by manipulation of said handle portion and being operable when in said unlatched position to permit pivoting of said actuator from said neutral position to either of said first and second actuated positions, second biasing means for urging said actuator to pivot from said first actuated position toward said neutral position, said latch being free of positive and frictional engagement with said housing when said actuator is in said first actuated position thereby to enable said second biasing means to return said actuator from said first actuated position to said neutral position when said actuator is manually released, and said biasing means being operable for pressing said latch into frictional engagement with said housing when said actuator is in said second actuated position for releasably maintaining said actuator in said second actuated position.

6. A safety switch comprising a housing having a pair of switch contacts each movable between first and secant states, each of said contacts normally being disposed in said fist state, a switch actuator having mounting pins projecting therefrom, said housing being formed with holes for receiving said pins to support said actuator for pivotable movement relative to said housing, said actuator having a neutral position in which said actuator leaves each of said contacts in said first state, said actuator being manually pivotable in one direction from said neutral position to a first actuated position in which the actuator changes one of said contacts from said first state to said second state, said actuator being manually pivotable in the opposite direction from said neutral position to a second actuated position in which said actuator changes the other of said contacts from said first state to said second state, a latch mounted on said actuator and having a handle portion, said latch and said handle portion being pivotable with said actuator between said positions and being slidable relative to said actuator between latched and unlatched positions, said latch being formed with elongated slots for receiving said actuator mounting pins to support said latch for sliding movement between said latched and unlatched positions, first biasing means for urging said latch toward said latched position, said latch being positively engageable with said housing when said latch is in said latched position and said actuator is in said neutral position and acting to prevent pivoting of said actuator from said neutral position to either of said first and second actuated positions, said latch being manually slidable to said unlatched position by manipulation of said handle portion and being operable when in said unlatched position to permit pivoting of said actuator from said neutral position to either of said first and second actuated positions, second biasing means for urging said actuator to pivot from said first actuated position toward said neutral position, said latch being free of positive and frictional engagement with said housing when said actuator is in said first actuated position thereby to enable with said second biasing means to return said actuator from said first actuated position to said neutral position when said actuator is manually released.

7. A safety switch comprising a body having a pair of spaced switch contacts each movable between first and second states, each of said contacts normally being disposed in said first state, manually movable switch actuator having a neutral position in which said actuator leaves each of said contacts in said first state, said actuator being movable in one direction from said neutral position to a first actuated position in which the actuator changes one of said contacts from said first state to said second state, said actuator being movable in the opposite direction from said neutral position to a second actuated position in which said actuator changes the other of said contacts from said first state to said second state, a latch mounted on said actuator and having a handle portion, said latch and said handle portion being movable with said actuator between said positions and being movable relative to said actuator between latched and unlatched positions, said latch and actuator being formed with cooperating pins and elongated slots for receiving supporting said latch for sliding movement between said latched and unlatched positions, means biasing said latch toward said latched position, said latch being engageable with said body when said latch is in said latched position and said actuator is in said neutral position and acting to prevent movement of said actuator from said neutral position to either of said first and second actuated positions, and said latch being manually movable to said unlatched position by manipulation of said handle portion and being operable when in said unlatched position to permit movement of said actuator from said neutral position to either of said first and second actuated positions.

8. A safety switch as defined in claim 1 in which said actuator is mounted within an upwardly opening recess of said body, and said latch being engageable with a top of said body when in said latched position.

9. A safety switch comprising a body having a pair of switch contacts each movable between first and second states, each of said contacts normally being disposed in said first state, a manually movable switch actuator having a neutral position in which said actuator leaves each of said contacts in said first state, said actuator being movable in one direction from said neutral position to a first actuated position in which the actuator changes one of said contacts from said first state to said second state, said actuator being movable in the opposite direction from said neutral position to a second actuated position in which said actuator changes the other of said contacts from said first state to said second state, a latch mounted on said actuator and having a handle portion, said latch and said handle portion being movable with said actuator between said positions and being movable relative to said actuator between latched and unlatched positions, first biasing means for urging said latch toward said latched position, said latch being positively engageable with said body when said latch is in said latched position and said actuator is in said neutral position and acting to prevent movement of said actuator from said neutral position to either of said first and second actuated positions, said latch being manually movable to said unlatched position by manipulation of said handle portion and being operable when in said unlatched position to permit movement of said actuator from said neutral position to either of said first and second actuator from said first actuated position toward said neutral position, said latch being free of positive and frictional engagement with said body when said actuator is in said first actuated position thereby to enable said second biasing means to return said actuator from said first actuated position to said neutral position when said actuator is manually released, and said first biasing means presses said latch into frictional engagement with said body when said actuator is in said second actuated position thereby to releasably maintain said actuator in said second actuated position.

10. A safety switch comprising a body having a pair of switch contacts each movable between first and second states, each of said contacts normally being disposed in said first state, said body being formed with an upwardly opening recess, a manually movable switch actuator mounted in said body recess, said switch actuator having a neutral position in which said actuator leaves each of said contacts in said first state, said actuator being movable in one direction from said neutral position to a first actuated position in which the actuator changes one of said contacts from said first state to said second state, said actuator being movable in the opposite direction from said neutral position to a second actuated position in which said actuator changes the other of said contacts from said first state to said second state, a latch mounted on said actuator and having a handle portion, said latch and said handle portion being movable with said actuator between said positions and being movable relative to said actuator between latched and unlatched positions, said latch being positively engageable with a top of said body when said latch is in said latched position and said actuator is in said neutral position and acting to prevent movement of said actuator from said neutral position to either of said first and second actuated positions, said latch being manually movable to said unlatched position by manipulation of said handle portion and being operable when in said unlatched position to permit movement of said actuator from said neutral position to either of said first and second actuated positions, and said latch being positionable into said body recess upon movement of said latch to said unlatched position and movement of said actuator and latch to said first position.

* * * * *